US005366115A

United States Patent [19]

Kersten et al.

[11] Patent Number: 5,366,115

[45] Date of Patent: Nov. 22, 1994

[54] DEFORMABLE CONTAINER FOR DELIVERING LIQUID

[75] Inventors: Jens-Heinrich Kersten, Kamen-Heeren; Detlef Schmitz, Lunen, both of Germany

[73] Assignee: Perfect-Valois Ventil GmbH, Dortmund-Wickede, Germany

[21] Appl. No.: 78,549

[22] Filed: Jun. 16, 1993

[30] Foreign Application Priority Data

Jun. 17, 1992 [DE] Germany ..... 4219857

[51] Int. Cl.[5] ..... B65D 35/56

[52] U.S. Cl. ..... 222/105; 222/212; 222/481.5; 222/484; 222/496; 222/548

[58] Field of Search ..... 222/105, 212, 215, 481, 222/481.5, 482, 484, 491, 495, 496, 548, 570

[56] References Cited

U.S. PATENT DOCUMENTS

| | | | |
|---|---|---|---|
| 1,390,549 | 9/1921 | Silverthorne | 222/548 |
| 2,966,282 | 12/1960 | Geisler | 222/215 X |
| 3,170,633 | 2/1965 | Castelli et al. | 239/327 |
| 3,474,936 | 10/1969 | McDonnell | 222/212 X |
| 3,838,796 | 10/1974 | Cohen | 222/105 |
| 4,159,790 | 7/1979 | Balley | 222/211 |
| 4,401,270 | 8/1983 | McKinney | 239/327 |
| 4,699,299 | 10/1987 | Gach | 222/480 |
| 4,785,974 | 11/1988 | Rudick et al. | 222/105 |
| 5,058,778 | 10/1991 | Weinstein | 222/209 |
| 5,079,013 | 1/1992 | Belanger | 222/482 X |
| 5,115,946 | 5/1992 | Libit | 222/212 X |
| 5,165,581 | 11/1992 | Uhl | 222/548 X |

FOREIGN PATENT DOCUMENTS

| | | | |
|---|---|---|---|
| 4027539-A1 | 8/1990 | Germany . | |
| 2234965 | 2/1991 | United Kingdom | 222/212 |
| WO91/13003 | 9/1991 | WIPO . | |

*Primary Examiner*—Andres Kashnikow
*Assistant Examiner*—Joseph A. Kaufman
*Attorney, Agent, or Firm*—Dressler, Goldsmith, Shore & Milnamow, Ltd.

[57] ABSTRACT

The invention relates to a deformable container (10) for delivering a liquid from a dispensing opening (12) on the sealing part (14), there being assigned to the ventilating opening (90) of the container (10) a ventilating valve (18) which is open in the event of underpressure in the container (10). The sealing part (14) is disposed on a metering element (20), which is inserted sealingly in the opening in the container (10) and is provided with two outlet ducts (24, 26). The outlet ducts (24, 26) serve to dispense the liquid in jet or drop form and can optionally be connected, by twisting the sealing part (14), to the dispensing opening (12) of the sealing part (14). The liquid is located in an inner bag (50), which is connected, in each case via a shut-off valve (64, 66), to the outlet ducts (24, 26). In an overhead position of the container (10), the liquid can be dispensed by compression of the container walls, depending upon the setting of the sealing part (14), in drop or jet form, by the corresponding nonreturn valve (64, 66) being opened whilst the ventilating valve (18) remains simultaneously closed. The nonreturn valve in question closes automatically, whilst the ventilating valve opens whenever the pressure exerted upon the container walls is lifted.

6 Claims, 2 Drawing Sheets

DEFORMABLE CONTAINER FOR DELIVERING LIQUID

The invention relates to a deformable container according to the claims.

BACKGROUND OF THE INVENTION

A deformable container of this generic type is known from U.S. Pat. No. 5,058,778. The deformable container comprises in this case a pump-free squeeze flask of the container, a cap-shaped sealing cap, provided with a dispensing nozzle and a ventilating valve, being able to be twisted with a snap seat, on a lid inserted by means of a snap seat in the flask neck, between a closed setting and an open setting.

From U.S. Pat. No. 4,699,299, a dispensing seal for containers is known, comprising a sealing element which can be screwed onto the container and in the top side of which there is provided a through opening for the container contents, which opening, in dependence upon a sealing cap disposed rotatably on the sealing element, can be brought into contact with, in each case, one of a plurality of openings of different diameter in the sealing cap.

In U.S. Pat. No. 3,170,633, a dispenser is described for dispensing liquid antiseptics in the form of a spray, drops or by pouring, depending upon the wound and the purpose for which the antiseptic is to be used. In the neck of a squeeze flask there is inserted a valve-holding device 17, a valve being disposed, in turn, within the valve-holding device 17. The valve-holding device exhibits a lateral outlet opening. The valve 18 has a latch handle 20, which is movable on the top side of the valve mounting and is provided on handle wings with indications displaying the different positions of the valve and its openings in relation to the dispensing opening. The valve has four radial positions about the valve axis, so that the valve is rotated by 90° each time into a further setting corresponding to the spray, drop, flow and "closed" positions.

U.S. Pat. No. 4,401,270 describes a spraying device for a squeeze flask, which device is designed to dispense a spray jet of a current and to seal the flask. A sealing element for the flask exhibits through ducts, a through duct for air being provided close to a mixing chamber. The liquid is conducted through an immersion tube and supply ducts and then into the side of an air current, so that the liquid is broken up by the generated turbulence. Following mixing, the spray jet flows through an opening into a ring. The ring can be adjusted in order to seal the mixing chamber and align the outlet opening with a liquid duct, so that a constant current of liquid is dispensed from the container, or the ring can be adjusted such that all the ducts are shut off.

From WO 91/13 003, a squeeze flask having a bag for liquids disposed therein is known, a ventilating device being connected to the space between the squeeze flask and the flexible bag.

From U.S. Pat. No. 4,159,790 there is derived a squeeze flask having a neck onto which there is screwed a cap, which cap is provided with a ventilating valve. An outlet extends through the cap, there being disposed in the outlet a one-way valve which allows liquid to be dispensed through the outlet. A projection of the cap extends into the flask neck and contains a part of the outlet duct and is connected to an immersion tube. A neck of the flexible bag is firmly connected to the immersion tube, in which openings are contained, in order to facilitate the passage of the liquid from the bag into the immersion tube.

From German Offenlegungsschrift 40 27 539, a squeeze flask having an inner bag is known, the seal of which seals the space located between the inner and outer container and also seals the contents against the external atmosphere and against the interspace. The seal contains a dispensing valve and a ventilating valve for the interspace. The neck of the inner bag is supported by a sleeve in the container neck, which sleeve exhibits recesses through which the interspace between the inner and outer container is connected to the ventilating valve.

SUMMARY OF THE INVENTION

The object of the invention is to improve a deformable container of the known generic type specified in the preamble of the claims such that it is suitable, in an overhead location, for dispensing liquids of different viscosity by compression of the liquid container, the liquid being able to be stored in the container without the addition of preservatives and, moreover, the application of the liquid being possible in jet or drop form.

The invention achieves this object by the defining features of the claims.

A particularly advantageous embodiment of the invention relates to a deformable container having a dispensing opening and a ventilating opening, a bag, made from deformable, liquid-tight and airtight material and for receiving the liquid to be dispensed, being disposed in an airtight manner in the container, an interspace being left between the inner container wall and the bag.

Further expedient designs of the invention are contained in the subclaims.

BRIEF DESCRIPTION OF THE DRAWINGS

The invention is explained in greater detail below with reference to the schematic drawing of an illustrative embodiment, in which.

DETAILED DESCRIPTION OF THE INVENTION DESCRIPTION OF THE INVENTION

Figure 1:
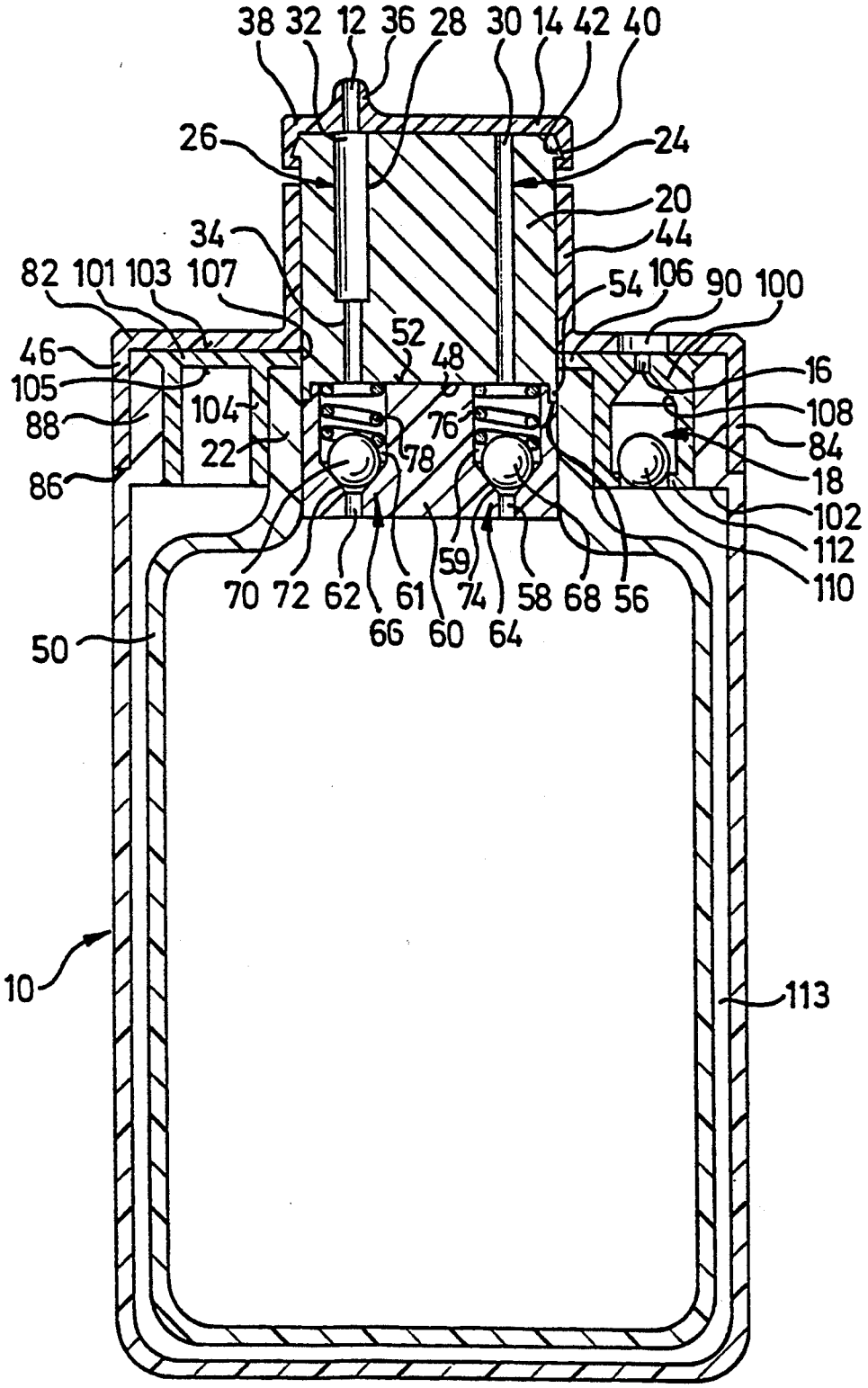
FIG. 1 shows a longitudinal section through a deformable container according to the invention.

In FIG. 1, a synthetic container 10 is shown, having flexible, manually compressible side walls for delivering a liquid from a dispensing opening 12 of a sealing part 14 of the container 10. The dispensing opening 12 of the sealing part 14 is formed by a dispensing nozzle 36, which is disposed eccentrically and parallel to the principal axis of the container 10. The sealing part 14 is provided with a casing 38, the inner side of which exhibits a circumferential latch groove 40.

A metering element 20 is inserted in a neck 44 of a cap-shaped container seal 46. An upper end and a lower end of the metering element 20 protrude respectively upwards and downwards beyond the corresponding ends of the said neck 44. The upper end of the metering element 20 exhibits, on its periphery, a latch boss 42, which tapers frustoconically upwards and over which the sealing part 14 reaches with its cap-shaped casing 38, so that the latch boss 42 engages in the latch groove 40 and the sealing part 14 is held seal-tight on the metering element 20, but twistably about a principal axis of the metering element 20.

The metering element 20 is provided with a first outlet duct 24 and a second outlet duct 26. The first outlet duct 24 is of smooth-cylindrical configuration and serves to dispense liquid in the form of a jet. By contrast, the second outlet duct 26 exhibits initially, in the flow direction of the liquid, a first longitudinal section 34, which extends over approximately one third of the height of the metering element 20. This longitudinal section 34 is adjoined in the flow direction of the liquid by a second longitudinal section 28 of the second outlet duct 26, the cross section of which is dimensioned substantially greater than that of the first longitudinal section 34. This second outlet duct 26 serves to dispense liquid in the form of drops. For this purpose, the linear and diametrical relationship of the first, narrower longitudinal section 34 to the second, widened longitudinal section 28 of the second outlet duct 26 is chosen such that the flow velocity of the liquid in the widened longitudinal section 28 of the second outlet duct 26 is lower than the dropping velocity of the liquid from its widened longitudinal section 28.

The two outlet ducts 24, 26 are mutually parallel and are aligned with the perpendicular principal axis of the metering element 20 and lie, with their outlet openings 30 and 32 respectively at an angular distance apart on a circle described by the dispensing opening 12 when the sealing part 14 is rotated on the metering element 20. Consequently, the sealing part 14 can optionally be twisted between a closed setting and two open settings over the outlet openings 30, 32.

The lower end of the metering element 20 engages sealingly in the opening in a neck 22 of an inner bag 50 containing the liquid to be dispensed. Protruding axially from the peripheral rim of a lower front face 48 of the metering element 20 are centering tongues 54, the purpose of which is explained below.

The lower front face 48 of the metering element 20 bears upon an upper front face 52 of a valve body 60, which is likewise inserted sealingly in the neck 22 of the inner bag 50 and exhibits the same diameter as the metering element 20. On the outer periphery of the upper front face 52 of the valve body 60 there are provided centering recesses 56, in which the centering tongues 54 of the metering element 20 engage in an exact fit. In this case, the centering recesses 56 and the centering tongues 54 can exhibit, in pairs, different dimensions or angular distances, thereby ensuring, in the assembly, the desired assembly position of metering element and valve body and hence bag 50 and the outlet openings 30, 32 of the metering element 20. bag 50 and the outlet openings 30, 32 of the metering element 20.

For the creation of this liquid connection to the outlet ducts 24, 26 of the metering element 20, there are provided in the valve body 60 two pass-through ducts 58, 62 which, as FIG. 1 shows, lie flush with the first outlet duct 24 or the second outlet duct 26 of the metering element 20. These pass-through ducts 58, 62 are widened upwards to form a valve chamber 59, 61. In the valve chambers 59, 61, there is in each case disposed a ball valve 68, 70 of a shut-off valve 64, 66, which ball valves are held on a valve seat 72, 74 by compression springs 76, 78 and therefore normally seal off the pass-through ducts 58, 62 of the valve body 60. The upper ends of the compression springs 76, 78 bear against the lower front face 48 of the metering element 20 in such a way that the compression springs 76, 78 are subjected, in the associated valve chamber 59, 61, to a certain pre-tension.

The container seal 46 is provided with an outer ring shoulder 82, in which there is provided a ventilating opening 90 and which connects the neck 44 of the container seal 46 to a downwardly extending sealing casing 84. The container 10 is provided with a neck 88 which is stepped by virtue of an outer shoulder 86, onto which the container seal 46 is mounted to provide a fit. As FIG. 1 shows, the outer surfaces of the sealing casing 84 and of the container 10 form a smooth, essentially seamless surface of the pack, since the wall thickness of the sealing casing 84 corresponds to the width of the outer shoulder 86.

Fitted sealingly in the container neck 88 is a support 100, the end wall 101 of which exhibits a plane, horizontal top side 103 lying flush with the end face of the container neck 88. An underside 105 of the end wall 101 is disposed level with an inner shoulder 102 which is formed by the container neck 88. An annular wall 104 protrudes downwards from the underside 105 of the end wall 101 and encloses, sealingly, the outer surface of the bag neck 22. The underside 105 of the end wall 101 herewith covers, in a seal-tight manner, the end face of the bag neck 22. The end wall 101 has a central opening 107 surrounded by a rim 106, which rim bears in a seal-tight manner against the peripheral surface of the lower end of the metering element 20 and covers the end face of the neck 22 of the inner bag 50.

The support 100 receives the ventilating valve 18. For this purpose, the end wall 101 of the support 100 is provided with a ventilating opening 16 lying flush with the ventilating opening 90 in the container seal 46. The ventilating opening 16 widens out in the direction of the interior of the container 10 and forms a conical valve seat 108 for a ball valve 110, which normally, in the open setting of the ventilating valve 18, is supported by radially inwards projecting supporting arms 112. Since interspaces are provided between the supporting arms 112 in the peripheral direction of the valve opening, in the open setting of the ventilating valve 18 shown in FIG. 1 air is able to circulate between the ball valve 110 and the supporting arms 112, so that an interspace 113 between the wall of the container 10 and the outer side of the inner bag 50 is permanently ventilated. If, in order to actuate the container 10, its flexible wall is manually compressed, the ball valve 110 is moved upwards and pressed against its valve seat 106, so that the ventilating valve 18 is closed. Upon further compression of the container wall, the inner bag 50, consisting of soft, yet liquid-tight material, becomes compressed, so that the liquid contained in the inner bag opens one of the two shut-off valves 64 or 66, provided that the sealing part 14 is found in one of its opening settings. The dispensing of the liquid is made considerably easier by an overhead positioning of the pack.

Figure 3:
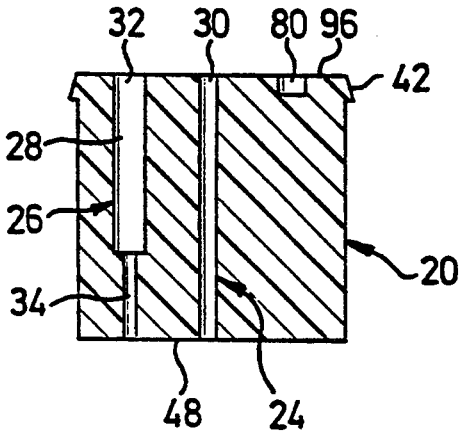
FIG. 3 shows the sealing cap in a central cross section according to the sectional line III—III in FIG. 2.
Figure 2:
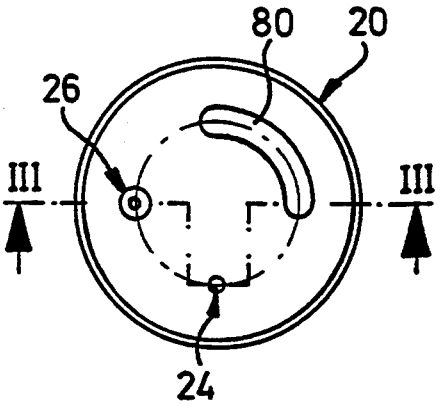
FIG. 2 shows a top view onto a sealing cap.

In FIGS. 2 and 3, the metering element 20 is represented in greater detail. FIG. 2 shows that the outlet ducts 24, 26 are mutually offset at an angular distance of 90°, but are disposed at an equal distance to the principal axis of the metering element 20 on a circle concentric thereto. In the upper front face of the metering element 20, there is embedded, moreover, a limit groove 80, which extends concentrically to the principal axis at an angle of 90°.

Figure 5:
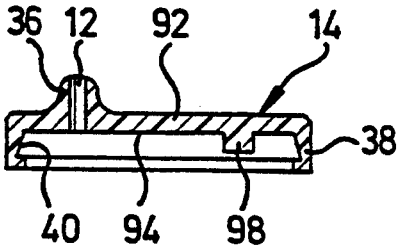
FIG. 5 shows the sealing part in a central cross section according to the sectional line V—V in FIG. 4.
Figure 4:
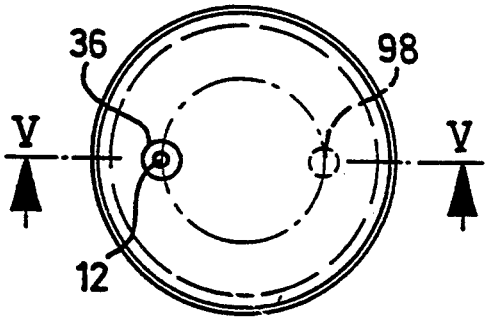
FIG. 4 shows a top view onto a sealing part.

FIGS. 4 and 5 show the sealing part 14 as a dispensing head matched to the metering element 20. The sealing part 14 comprises a cover plate 92, which passes through the dispensing opening 12 in the dispensing nozzle 36. The downwardly extending casing 38 is provided, at its lower end, with the inner latch groove 40, which grips, by snap action, under the outer latch boss 42 of the metering element 20 whenever the sealing part 14 is mounted onto the metering element 20. The sealing part 14 bears with its underside 94, in a seal-tight manner, upon an upper end face 96 of the metering element 20.

Protruding from the underside 94 of the sealing part 14, moreover, is a stop cam 98, which engages movably in the limit groove 80 on the top side of the metering element 20, in such a way that the sealing part 14 with the stop cam 98 can be twisted by 90° each time into the two end settings in the limit groove 80, the dispensing opening 12 being connected either to the outlet duct 24 or to the outlet duct 26. FIGS. 4 and 5 show that the dispensing opening 12 and the stop cam 98 are disposed diametrically opposite each other on a circle which is disposed concentrically to the principal axis of the metering element 20.

It can thus be seen that the sealing part 14 can be manually adjusted between the dispensing settings for drops or for a spray jet and a closed setting in which the dispensing opening 12 is located between the outlet ducts 24, 26.

What is claimed is:

1. A deformable container for delivering a liquid from a dispensing opening of a sealing part provided with a dispensing nozzle, which sealing part can be brought by a rotary motion into a closed setting or into an open setting, there being assigned to a ventilating opening a ventilating valve which is open in the event of underpressure in the container, which comprises the following features:

a) the sealing part is disposed on a metering element, which is inserted sealingly in the opening in the container and is provided with two outlet ducts;

b) the outlet openings of the outlet ducts have the same radial distance from the principal axis of the metering element and are mutually offset in the peripheral direction of the metering element;

c) the first outlet duct is of smooth-walled configuration for the dispensing of a liquid jet and the second outlet duct exhibits, for the dispensing of liquid drops, a longitudinal section having a stepped, widened cross section;

d) the linear and diametrical relationship of the narrower longitudinal section to the widened longitudinal section of the second outlet duct is chosen for the drop application such that the flow velocity of the liquid in the widened longitudinal section of the second outlet duct is lower than the drip velocity of the liquid from this widened longitudinal section of the second outlet duct;

e) the sealing part can be twisted with its dispensing opening into a position coaxial with either of the outlet openings of the meeting element;

f) the metering element bears upon a valve body provided with two pass-through ducts, which are connected to the outlet ducts of the metering element and respectively exhibit a shut-off valve, which can be actuated by the liquid, counter to a return spring, in the direction of opening.

2. The deformable container as claimed in claim 1, wherein the metering element protrudes, in an upwardly protruding neck part of the container seal, beyond the upper end and lower end of this neck part, the upwardly protruding end of the metering element being surrounded by a circular latch boss, whilst the casing of the sealing part is provided, on the inner side, with a corresponding latch groove by which the sealing part is mounted, by snap action, onto the metering element.

3. The deformable container as claimed in one of claims 1 or 2, wherein that end of the metering element protruding over the underside of the cap-shaped container seal and into the support is provided with centering tongues which protrude downwards from the outer rim of the lower front face of the metering element and wherein, on the outer periphery of that upper front face of the valve body lying opposite the metering element, there are provided centering recesses corresponding to the centering tongues, so that the outlet ducts of the metering element and the pass-through ducts of the valve body lie flush with one another when the container is assembled.

4. The deformable container as claimed in one of claims 1 or 2, having a bag, made from deformable, liquid-tight and airtight material and for receiving the liquid to be dispensed, being disposed in an airtight manner in the container, an interspace being left between the inner container wall and the bag, wherein the valve body is inserted in a seal-tight manner in the opening in the bag, the interior of which is connected to the outlet ducts of the metering element;

the neck of the liquid bag is clamped in a seal-tight manner between the valve body filling the neck opening and a support surrounding the bag neck on the outside;

the support is inserted in a seal-tight manner in the container neck and receives the ventilating valve;

the top side of the support is covered by a cap-shaped container seal, which is fastened sealingly on the container neck.

5. The deformable container as claimed in claim 1, wherein the counter-bearing for the upper end of the return springs of the shut-off valves is formed by that lower front face of the metering element lying opposite the valve body.

6. The deformable container as claimed in claim 1, wherein the two opening settings and the closed setting of the sealing part are determined by latch stops.

* * * * *

UNITED STATES PATENT AND TRADEMARK OFFICE

CERTIFICATE OF CORRECTION

PATENT NO. : 5,366,115

DATED : November 22, 1994

INVENTOR(S) : Jens-Heinrich Kersten and Detlef Schmitz

It is certified that error appears in the above-indentified patent and that said Letters Patent is hereby corrected as shown below:

Column 2, lines 49-51, the heading should read --DETAILED DESCRIPTION OF THE INVENTION--;

Column 3, line 54, before "bag 50" insert --the liquid connection between the interior of the inner--;

Column 6, line 3, "meeting" should be --metering--.

Signed and Sealed this

Seventh Day of March, 1995

Bruce Lehman

*Attest:*

BRUCE LEHMAN

*Attesting Officer*

*Commissioner of Patents and Trademarks*